US005879194A

United States Patent [19]

Thenaisie et al.

[11] Patent Number: 5,879,194

[45] Date of Patent: Mar. 9, 1999

[54] SHIELDED CONNECTOR OF THE TYPE COMPRISING A PLUG AND A SOCKET AND PROVIDED WITH A LOCKING/UNLOCKING COMPONENT

[75] Inventors: Jacky Thenaisie, Le Mans; Patrick Champion, Change, both of France

[73] Assignee: Framatome Connectors International, Courbevoie, France

[21] Appl. No.: 837,296

[22] Filed: Apr. 11, 1997

[30] Foreign Application Priority Data

Apr. 12, 1996 [FR] France ..... 96 04597

[51] Int. Cl.[6] ..... H01R 13/648

[52] U.S. Cl. ..... 439/607; 439/358

[58] Field of Search ..... 439/607, 609, 439/108, 350, 352, 354, 357, 358

[56] References Cited

U.S. PATENT DOCUMENTS

| | | | |
|---|---|---|---|
| 2,760,174 | 8/1956 | Buntt et al. | 439/358 |
| 3,398,390 | 8/1968 | Long | 439/358 |
| 5,021,002 | 6/1991 | Noschese | 439/357 |
| 5,088,932 | 2/1992 | Nakamura | 439/350 |
| 5,141,445 | 8/1992 | Little | 439/108 |
| 5,259,773 | 11/1993 | Champion et al. | 439/108 |
| 5,277,624 | 1/1994 | Champion et al. | 439/607 |
| 5,356,301 | 10/1994 | Champion et al. | 439/108 |
| 5,716,228 | 2/1998 | Chen | 439/350 |

FOREIGN PATENT DOCUMENTS

| | | |
|---|---|---|
| 0351083 A3 | 1/1990 | European Pat. Off. . |
| 0637858 A1 | 2/1995 | European Pat. Off. . |
| 0649195 A1 | 4/1995 | European Pat. Off. . |
| A-1098645 | 8/1955 | France . |

*Primary Examiner*—Hien Vu
*Attorney, Agent, or Firm*—Perman & Green, LLP

[57] ABSTRACT

The invention concerns a shielded connector of the type comprising a socket (1) attached to a printed circuit board (CI) and a plug (7) designed to be mechanically and electrically coupled to socket (1). A first shielding component (2, 4) is extended by elastic locking projections (22) provided with hooks (24). Shielding (9*a*) of plug (7) has openings (90*a*) into which these hooks (24) engage. Projections (22) rub against shielding (9*a*) of plug (7) and establish a galvanic contact between shieldings (9*a*, 2–4) of plug (7) and socket (1). They assure a locking of the latter in socket (1). First projection (22) has a separate piece (3) of insulating material forming a lever that permits unlocking plug (7) and socket (1), when a pressure force ($F_1$) is exerted on projection (3) and an extraction force ($F_2$) is exerted on plug (7).

9 Claims, 4 Drawing Sheets

SHIELDED CONNECTOR OF THE TYPE COMPRISING A PLUG AND A SOCKET AND PROVIDED WITH A LOCKING/UNLOCKING COMPONENT

BACKGROUND OF THE INVENTION

1. Field of the Invention

The present invention concerns a shielded connector and more precisely a shielded connector of the type comprising a plug and a socket and provided with a locking/unlocking component.

It more particularly concerns connectors designed to be attached onto a flat support, notably a printed circuit board provided with metallized holes.

The Applicant proposed in European Patent Application EPA-0 649,195 a connection element having an insulating bridge piece with a "U" shaped section and elbow contact elements emerging into the "U" structure on one end. The other end is inserted by force ("press fit") into metallized holes of a printed circuit board. Moreover, according to one interesting characteristic, it has a rear insulating component surrounding the electrical contact elements in their bent part and a holding piece also inserted into the printed circuit board.

This connection element forms a socket designed to receive a plug of complementary form. The arrangements used advantageously permit protecting the bridge piece during vacuum soldering operations of the connection element and the other components of the card.

For certain applications, it is necessary to have available a connector that is insensitive to electromagnetic interference, notably when the signals carried are signals called "weak" and at high or very high frequency. To do this, the connector elements must be provided with a shielding. Moreover, a good ground continuity must be made between the two elements (plug and socket), on the one hand, and between the socket and the printed circuit card, on the other hand.

2. Prior Art

Shielded connection elements have been proposed, for example, in the patents U.S. Pat. No. 5,277,624 (Patrick CHAMPION et al.), U.S. Pat. No. 5,259,773 (Patrick CHAMPION et al.) or U.S. Pat. No. 5,356,301 (Patrick CHAMPION et al.). These modular connection elements permit creating electrical contacts from a mother card and/or a daughter card.

In order to achieve ground continuity, two elastic metallic projections are provided in the form of a cross, of one piece with the socket and cooperating with openings pierced in the walls facing the socket, so as to come into galvanic contact with the shielding of the corresponding plug. Although this pair of projections exerts a pressure force on the plug, the holding of the plug inside the socket is especially accomplished by inserting the male contact elements of one of the components (for example, the socket) into the female contacts of the other component (for example the plug). In other words, a true locking is not provided and the quality of the ground continuity can fluctuate.

The invention therefore has for a subject a connector provided with an efficacious locking/unlocking component, while remaining simple.

It also has for a subject permitting a good ground continuity between the socket and the plug.

It therefore seeks to simultaneously fulfill these two functions, without having recourse to complex means.

In a preferred variant of embodiment, it also conserves, for the socket, the essentials of the advantageous structure of the connection element according to the above-mentioned European Patent Application EP-A-0 649,195.

In order to achieve the goal set, the invention notably provides a shielding element forming a spring, combined with a separate piece of insulating material arranged on the tip of the socket. The shielding element has a hook cooperating with an opening provided in one wall of the plug for assuring the locking function. Unlocking is effected simply by pressing on the separate piece and withdrawing the plug.

Moreover, the shielding element assures a good ground continuity by applying virtually its entire width on the plug shielding.

The assembly does not perceptibly increase the complexity of the manufacturing operations, nor the manufacturing cost.

SUMMARY OF THE INVENTION

The invention therefore has for a subject a shielded connector comprising a socket and a plug designed to be coupled by insertion of the plug into the socket, the plug being covered with a shield of electrical conductor material on at least one of its walls, characterized in that at least one first wall of the socket, corresponding to that of the plug, is covered with a shielding of electrically conductive material, in that this shielding is extended toward the front of the socket by at least one projection forming a spring, so as to rest on the plug shielding during insertion of the latter, in that at least one projection is provided with first hooking means, in that the plug shielding has second hooking means complementary to the first and cooperating with the latter so as to lock the plug into the socket after complete insertion of the latter, and permitting a galvanic contact between the shields of the plug and the socket, in that a separate piece of insulating material is engaged on the front end of the projection forming a spring, and in that this separate piece has the form of a lever resting on the shielding of the plug so as to release the first hooking means from the second hooking means by pressing on the separate piece, unlocking the plug and allowing its removal from the socket, when it is subjected to an extraction force.

BRIEF DESCRIPTION OF THE DRAWINGS

The invention will be better understood and other characteristics and advantages will appear upon reading the description which follows in reference to the attached figures, among which.

DETAILED DESCRIPTION

To allow better understanding without limiting in any way the scope of the invention, we will describe below one preferred example of embodiment of the connector according to the invention, i.e., a connector comprising a socket whose structure roughly conforms to that described in the above-mentioned European Patent Application EP-A-0 649, 195. Also in the following, only the elements indispensable to a good understanding of the invention will be specified. For a more detailed description of the socket, it would be helpful to refer to this European Patent Application.

Figure 1:
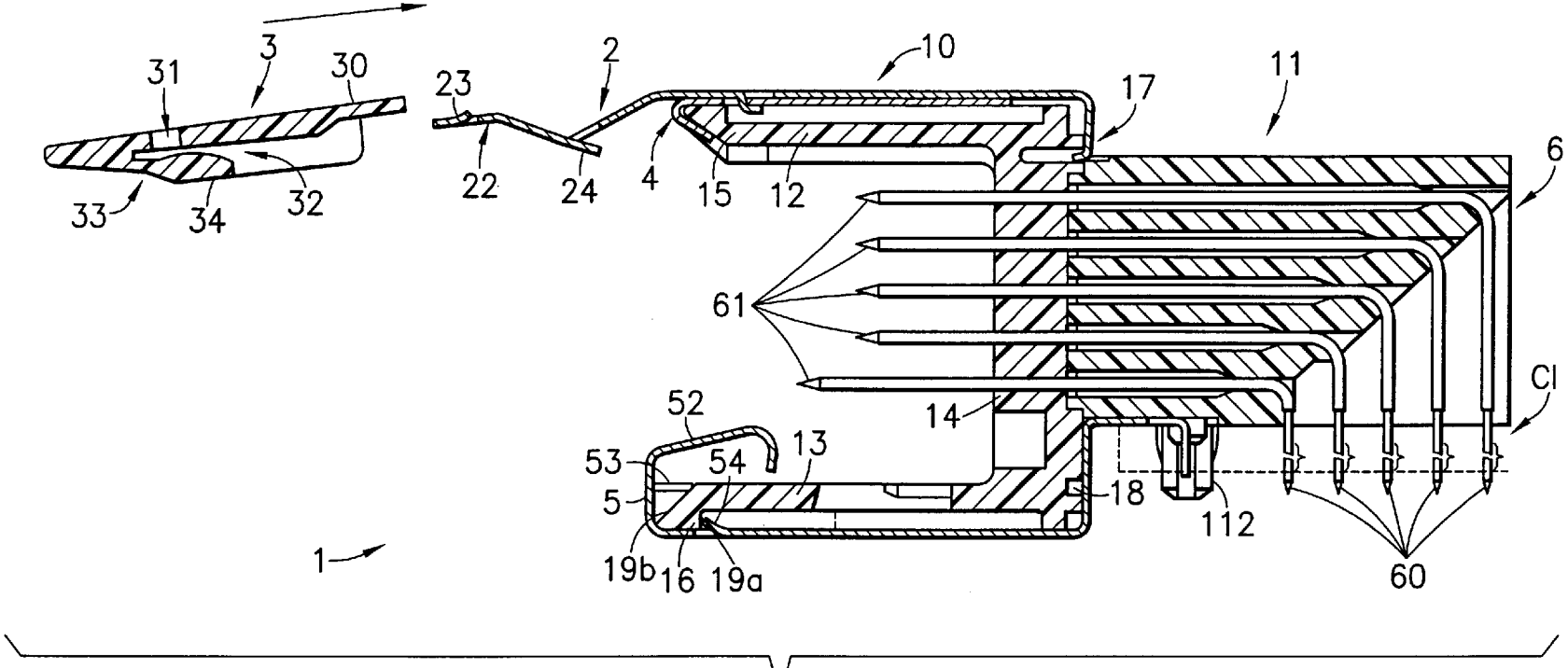
FIG. 1 is a cross-sectional elevation view which illustrates one preferred mode of embodiment for a connector socket according to the invention.

FIG. 1 illustrates such a socket 1, in longitudinal section. Other than the specific arrangements of the invention, which will be explained below, it essentially comprises three parts: an insulating front bridge piece 10, of "U" shaped section, a rear insulator 11, and a set of electrical contact elements 6 bent at a 90° angle. Front bridge piece 10 has two lateral branches 12 and 13 and a central region 14 pierced by electrical contact elements 6. In the example illustrated, they are male elements. The number of electrical contact elements 6 and their arrangement depend on the specific application. They are generally organized in a matrix form: lines and columns. Front parts 61 (linear) emerge between arms 12 and 13, and are designed to be inserted into female contacts carried by a plug (not shown in FIG. 1).

Arms 12 and 13 form at the front face a mouth comprising flared lips (chamfers) 15 and 16.

Rear insulating component 11 covers the rear of electrical contact elements 6, at least in the zone comprised between central region 14 of bridge piece 10 and the elbow of these electrical contact elements. Ends 60 of the vertical parts of the latter are inserted by force ("press fit") into metallized holes of a printed circuit board CI, and soldered in the usual way.

Rear insulating component 11 is advantageously provided with a holding piece 112 also pressed into printed circuit board CI.

According to a primary characteristic of the invention, the socket is provided with at least one shielding component and preferentially with two: 2, 4 and 5, arranged on the upper and lower surfaces, respectively, of upper and lower arms 12 and 13, of socket 1. These are a metal plate with a small thickness, but nevertheless sufficient to maintain a spring effect. For example, for sockets contained in a cube of approximately 30 mm per side, the typical thickness is 0.3 mm.

Figure 5:
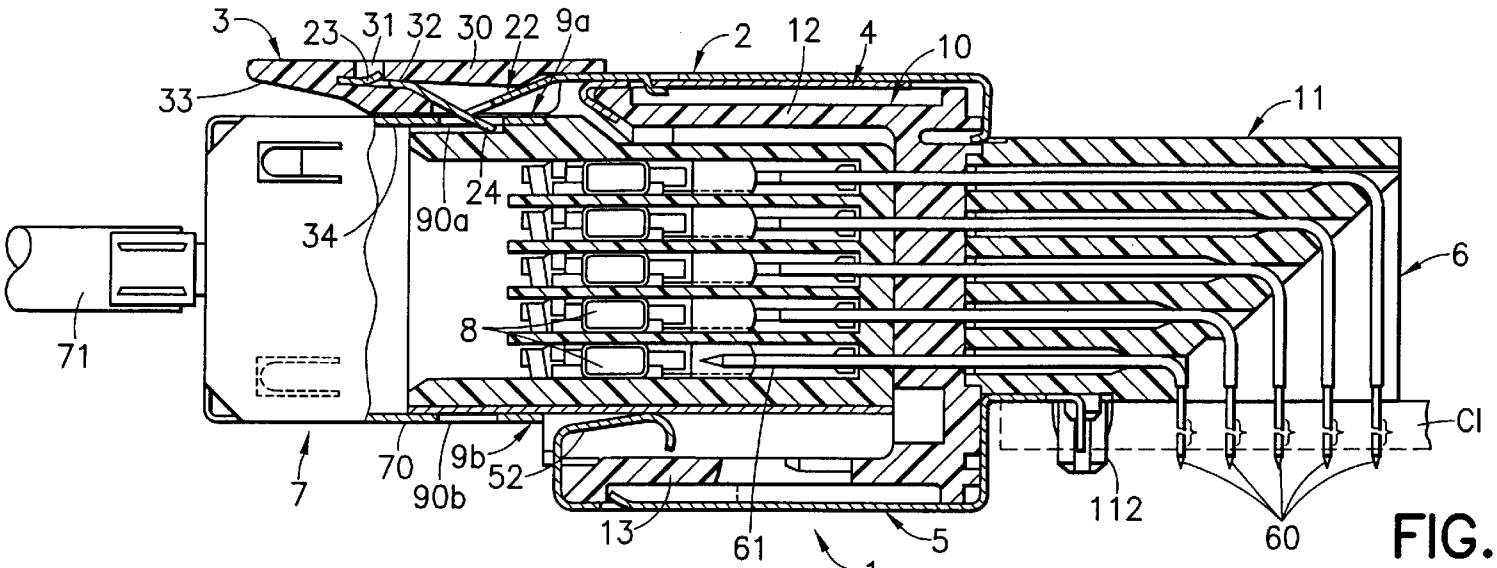
FIG. 5 illustrates, in section, a connector according to the invention for which the plug is locked in the socket.
Figure 6:
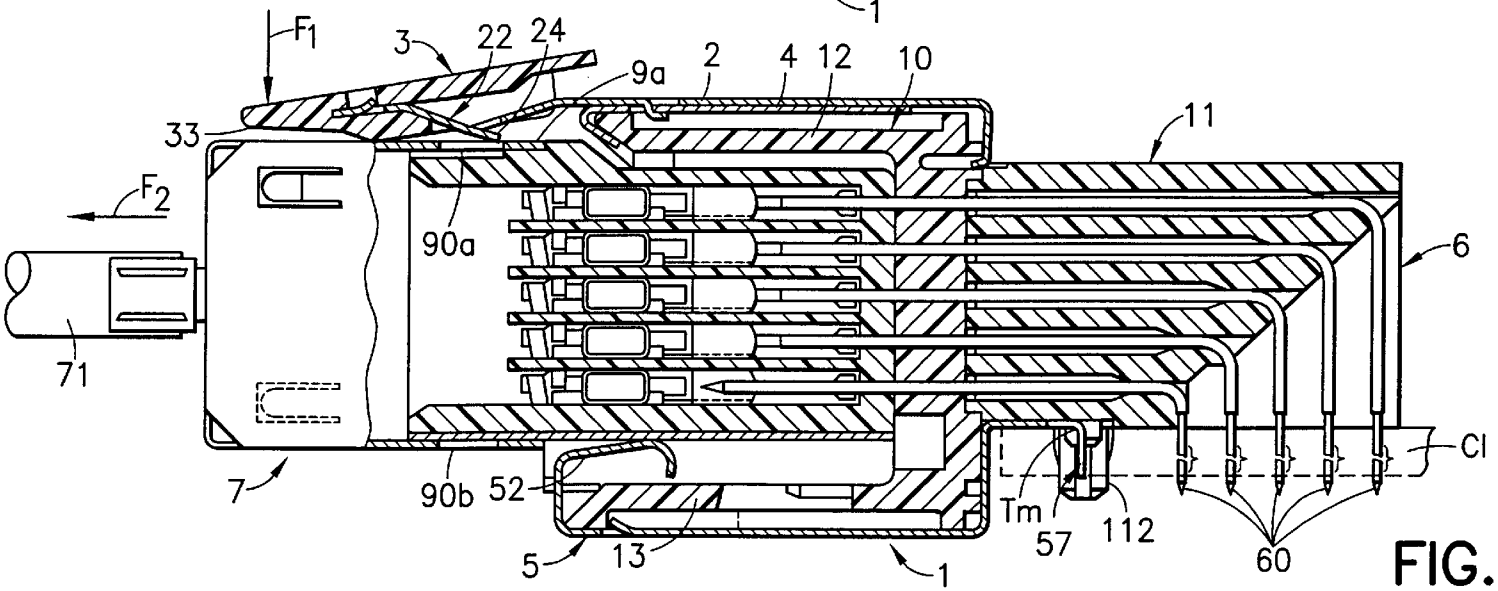
FIG. 6 illustrates, in section, the unlocking of the plug from the socket.

In addition to the primary function of shielding socket 1, this system also permits a good ground continuity with the shielding of a plug 7 inserted into socket 1, as is shown with reference to FIG. 5. Finally, it permits a locking of this same plug 7 inside socket 1.

Figure 2A:
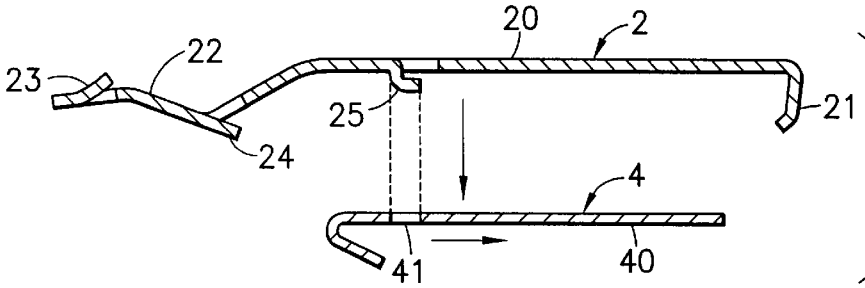
FIGS. 2*a* to 2*c* are detail figures illustrating the shielding element forming a spring combined with the socket according to FIG. 1.
Figure 2B:
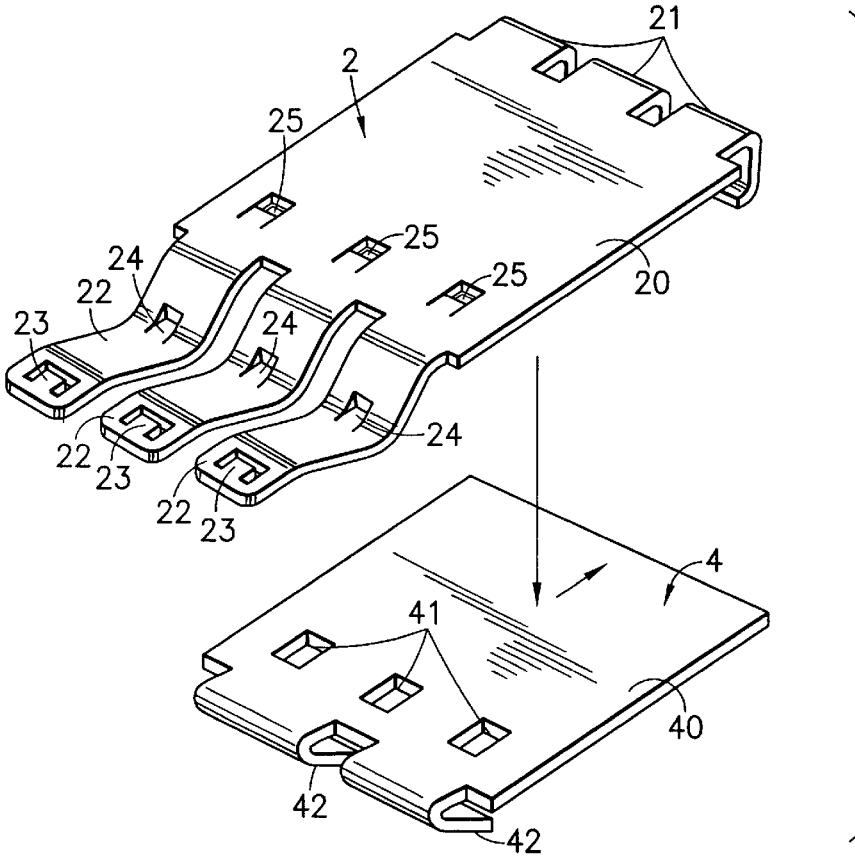
Figure 2C:
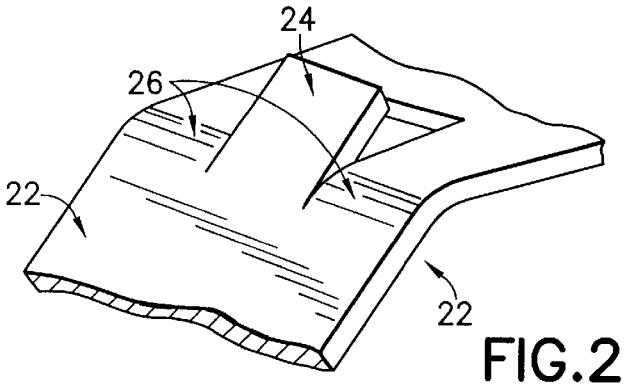

The upper shielding component comprises two plates 2 and 4. It is illustrated in a more detailed manner by FIGS. 2*a* and 2*b*. FIG. 2*a* illustrates, in section, the two plates 2 and 4 making up the upper component. FIG. 2*b* illustrates these two plates, in exploded view, before assembly and FIG. 2*c* illustrates a bottom detail of plate 2, after 180° rotation.

Plate 2, or locking bar, is made up of a principal body 20, extended on the front surface by tabs 22 forming a spring (three in the example described) whose shape is roughly that of a flared "V". This principal body 20 is extended on the rear by bent projections 21 (three in the example described) designed to hook onto the back of bridge piece 10. To do this, an appropriate slot or openings 17 are provided on central region 14.

Plate 4 has a principal body 40 covering the upper surface of upper arm 12 and is extended in the front by bent projections 42 (two in the example described) designed to hook onto the front of bridge piece 10, more precisely onto upper flared lip 15.

However, before joining these two plates 2 and 4 with bridge piece 10, they are assembled. To do this, a row of openings 41 (three in the example described) are provided in principal body 40 of plate 4 and projections 25 are cut in principal body 20 of plate 2. As shown in FIG. 2*b*, the two plates 2 and 4 are brought together and are joined to one another (vertical arrow), projections 25 being introduced into openings 41. Then, by a relative translation movement (horizontal arrow), the two plates are joined by engaging projections 25 in openings 41.

Figure 4:
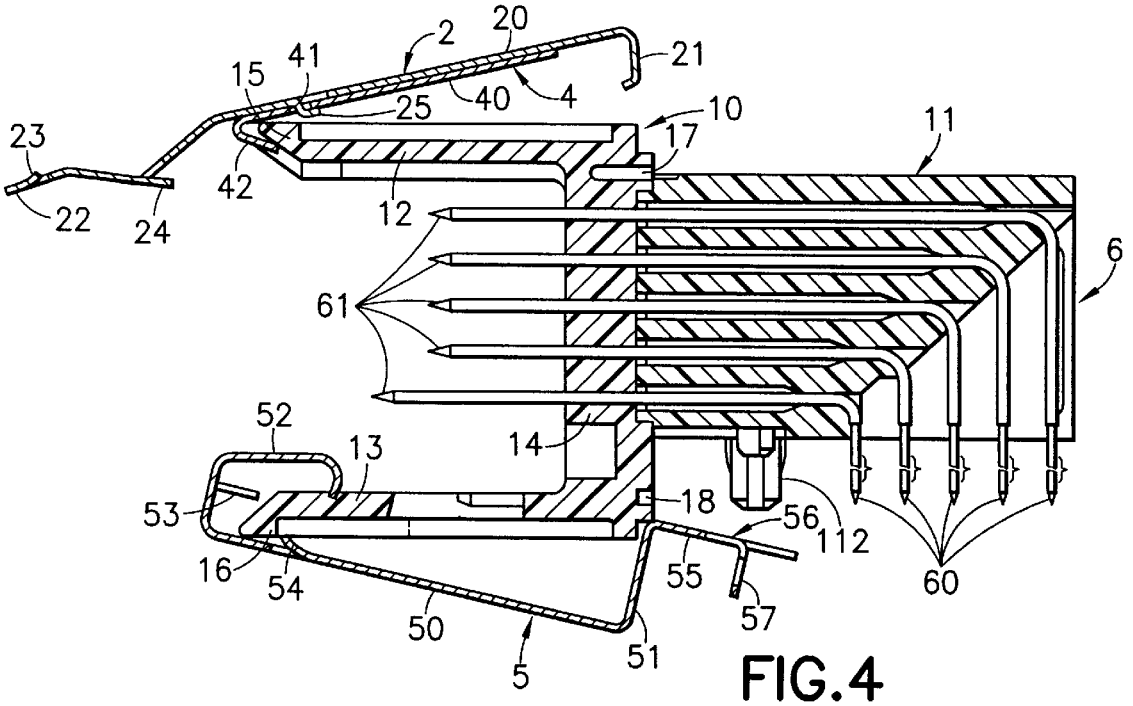
FIG. 4 illustrates the phases of mounting the shielding components of a socket according to the invention.

It is sufficient to ratchet this assembly, plates 2 and 4, onto the socket as is shown in FIG. 4. Bent projections 42 are hooked onto lip 15 and, by spring effect, bent projections 21 are ratcheted into the slot or openings 17.

Figure 3A:
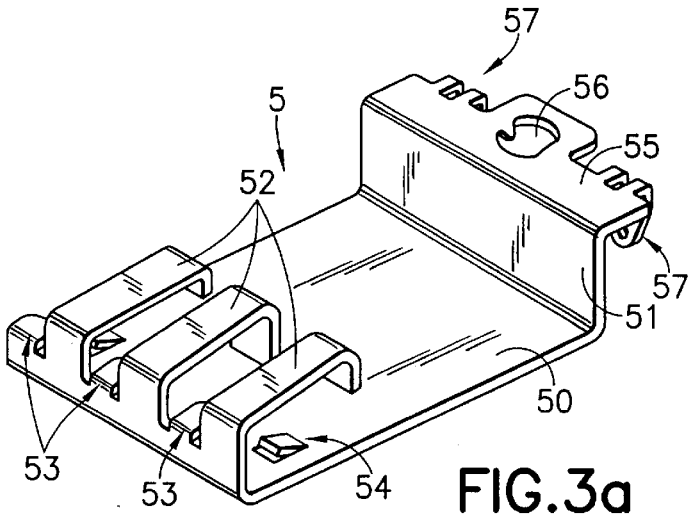
FIGS. 3A to 3C illustrate the phase of mounting the shielding onto the socket of FIG. 1.
Figure 3B:
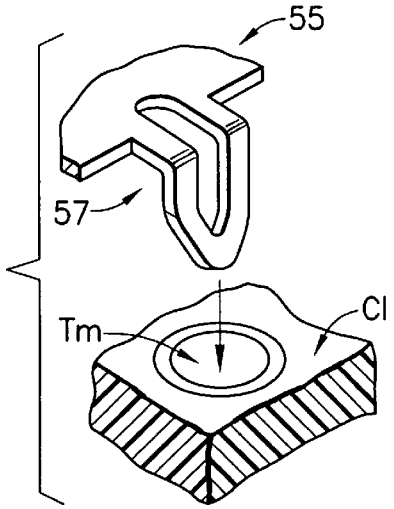
Figure 3C:
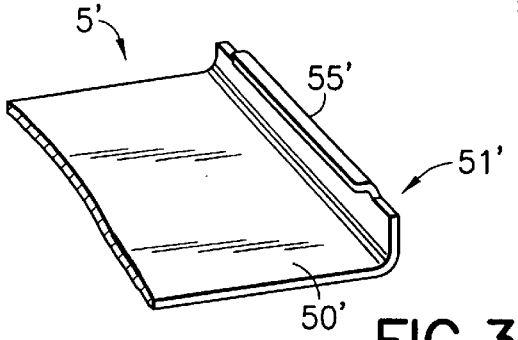

Lower shielding component 5 is illustrated more particularly by FIGS. 3*a* to 3*c*.

It comprises a principal body 50 virtually covering the lower surface of lower arm 13 of bridge piece 10. This principal body 50 is extended, toward the front, by projections or sliding contacts 52 bent back on themselves, so as to make a spring. Alternating with these projections, hooks 53 are provided, also made up of projections bent back on themselves, but of lower height. Finally, a set of projections or hooks 54 is also provided, cut into the front of principal body 50, but behind projections 53.

These hooks 54 cooperate with projections 53 so that plate 5 can be hooked onto lower lip 16 of bridge piece 10, as is shown more particularly in FIG. 4. This latter has a sharp rear wall 19*a* so that it is imprisoned between projections 53 which slide on front wall 19*b* of inclined slope, and hook 54, which is ratcheted onto rear surface 19*a* (see FIG. 1). Bent projections 52, forming a spring, re-enter inside bridge piece 10.

In a first variant illustrated by FIG. 3*a*, the principal body is extended by a vertical wall 51, bent in order to form a horizontal plate 55. This latter has an opening 56 designed to receive holding piece 112, before inserting the latter into printed circuit CI. According to this variant, plate 5 is joined to socket 1, on the one hand, by the set of front projections 53 and 54, and on the other hand, by holding piece 112, as shown in FIG. 4.

Advantageously, additional bent tabs 57 are provided on the rear of horizontal plate 55. The latter, as is shown in FIG. 3*b*, are inserted by force [press fit] into metallized holes Tm, made in the printed circuit board CI. This variant permits a good ground recovery on the printed circuit.

In a second variant, illustrated by FIG. 3*c*, lower plate 5' still has a principal body 50', which is terminated by a vertical wall 51', but the horizontal plate is replaced by a bend 55' toward the inside designed to be inserted into a slot 18 provided on the rear of central region 14 of bridge piece 10.

According to one important characteristic of the invention, the shielding components play a triple role: shielding properly speaking, ground continuity between at least the socket and the plug (and preferably also with the printed circuit) and locking/unlocking of the plug in the socket.

In order to more completely illustrate these functions, we will consider FIG. 5, which illustrates a complete connector according to the invention, comprising a socket 1 (such as has just been described) and a plug 7.

This latter classically comprises a principal body 70, of insulating material, imprisoning a set of electrical contact elements 8, complementary to electrical contact elements 6, of equal number, and arranged in space in an appropriate manner so that electrical coupling can be effected by introduction of the first into the second.

The set of electrical contact elements 8 is connected on the rear of plug 7 (in the example described) to a multistrand wire 71.

In one preferred variant of the invention, a shielding is provided on the outer walls , upper and lower, of plug 7: plates 9*a* and 9*b,* respectively.

The ground continuity between plug 7 and socket 1 is produced by the sliding friction contacts 52 on shielding 9*b,* on the one hand, and by the sliding friction of tabs 22 forming a spring on shielding 9*a,* more specifically of zone 26 making up the base of the "V" (see FIG. 2*c*).

It is observed that this zone is very large since it covers practically the entire width of upper arm 12 (except for the narrow zones of hooks 24, whose role will be specified below, and the slots between tabs 22). The galvanic contact is therefore of good quality, inasmuch as sliding contacts 52 also contribute to this contact and, in addition, by spring effect, have a tendency to press principal body 70 toward the top (i.e., toward tabs 22).

The locking function, for its part, is carried out simply by this spring effect. In fact, if shielding 9*a* is provided with openings 90*a* cooperating with hooks 24, when plug 7 is entirely inserted into socket 1, hooks 24 ratchet into these openings. This operation therefore locks plug 7 inside the socket and permits effective sliding friction of zones 26 of tabs 22 on shielding 9*a*.

For most applications, the coupling of plug 7 onto socket 1 must be reversible. It is therefore necessary to be able to unlock plug 7 and extract it from socket 1.

To do this, according to the most important characteristic of the invention, a separate piece 3 of insulating material is provided. This piece has the general shape of a projection having one or more slot(s) 32 into which the ends of projections 22 of plate 2 can be inserted (see FIG. 1). In order to be able to join this separate piece 3 to plate 2, openings 31 are provided in the bottom of slot or slots 32, so that hooks 23, made on the ends of projections 22 ratchet into these openings. Thus a locking of separate piece 3 onto plate 2 is obtained.

Lower front end 33 of separate piece 3 is chamfered, bottom 34 being flat. When plug 7 is inserted, bottom 34 of the separate piece slides on the upper wall of body 70 of plug 7, or more precisely on shielding 9*a*. Hooks 24 are introduced into openings 90*a* bringing about the locking of the plug and galvanic contact of zones 26, as previously described.

If one presses on the front of separate piece 3 (force $F_1$), due to above-mentioned chamfer 33, the latter rocks and hooks 24 are extracted from their housings 90*a*. If this pressure is maintained and a pulling force (arrow $F_2$) is exerted, the plug can then be released from socket 1, chamfer 33 sliding on the upper wall of plug 7. These two operations (pressure and withdrawal) can be effected simply. It is sufficient to push with, for example, the thumb of one hand on the front of separate piece 3, forming a lever, and pull on plug 7 with the other hand.

Upon reading the preceding, it is easily observed that the invention clearly attains its objectives. It permits at the same time an efficacious shielding, a good ground continuity between the socket and the plug (and also, in a preferential variant, with the printed circuit), as well as a locking of the plug in the socket. Unlocking is obtained simply by the addition of a separate piece, forming a lever, according to the principal characteristic of the invention.

In a subsidiary manner, the relative arrangement of sliding contacts 52 and projections 22 permits a good guiding of plug 7 during its introduction into socket 1.

These arrangements do not involve an appreciable increase of the complexity of the connector, nor of the manufacturing operations (when compared with a shielded connector). As has been shown in regard to FIG. 4, mounting is accomplished in a simple way. The increase in cost of the components is insignificant. It essentially concerns the addition of a separate piece, made of inexpensive insulating material.

It must nevertheless be clear that the invention is not limited to only the examples of embodiment precisely described, notably in relation to FIGS. 1 to 6. Variations of shape and/or dimensions only constitute choices of a technological order, imposed by specific applications. In addition, the materials that can be used are the usual materials in the field.

The connector can also comprise several individual connectors and at least one separate piece of insulating material engaged on the front end of one or more contiguous sockets, the separate piece thus joining the contiguous sockets for their simultaneous insertion onto the printed circuit.

Finally, other connector structures can be implemented, notably with regard to the socket. Although the information of the invention is particularly of interest for connectors whose socket is designed to be attached onto a printed circuit board, it should be clear that this condition is not indispensable.

What is claimed is:

1. A shielded connector comprising a socket (1) and a plug (7) designed to be coupled by insertion of the plug (7) into a front end of the socket (1), the plug being covered with a first shielding (9*a*) of electrically conductive material on at least one wall of the plug, wherein the improvement comprises:

the socket having at least one first wall corresponding to the wall of the plug (7), and being covered with a second shielding (2, 4) of an electrically conductive material, this second shielding (2, 4) being extended toward the front of socket (1) by at least one spring tab (22) adapted to rest on the first shielding (9*a*) of the plug (7) during insertion of the plug into the socket;

wherein the at least one spring tab (22) is provided with first hooking means (24);

wherein openings (90*a*) are arranged on the first shielding (9*a*) of the plug (7) to complement the first hooking means, the openings cooperating with the first hooking means so as to lock the plug (7) in socket (1) after complete insertion of the plug, and permitting galvanic contact between the first shielding of the plug (7) and the second shielding of the socket (1); and wherein a separate piece of insulating material (3) is engaged on a front end of the spring tab (22) so that the separate piece and front end of the projection move together as a unit, this separate piece (3) having a form of a lever resting on the first shielding (9*a*) of the plug (7) and being adapted to release first hooking means (24) from the openings (90*a*) by pushing downwardly on the separate piece (3), unlocking the plug (7) from the socket and allowing withdrawal of the plug from socket (1), when the plug is subjected to an extraction force ($F_2$).

2. A shielded connector according to claim 1, wherein the spring tab (22) is endowed with a "V"-shaped section, a base of the "V" rubbing against the first shielding (9*a*) of the plug (7);

wherein the first hooking means are made up of a hook (24) arranged under the "V"; and wherein the lever is adapted to rock when the lever is subjected to a pressure force ($F_1$) on a front zone of the lever, so that a rear zone of the lever is raised extracting the hook (24) from the opening (90*a*) and release the first hooking means from the openings.

3. A shielded connector according to claim 1, wherein the second shielding on the first wall of the socket (1) is made up of a stack of two plates (2, 4) provided with a third hooking means made up of complementary cut pieces permitting assembly of the stack of two plates, and upper one of the two plates (2) being provided with the spring tab (22); and wherein a lower one of the two plates (4) comprises a fourth hooking means (42) made up of cut pieces fitted into a mouth (15) of socket (1), and the upper plate (2) has a fifth hooking means made up of cut pieces (21) adapted to hook onto a rear of the socket, the fourth hooking means and fifth hooking means co-acting so that the stack of the two plates (2, 4) is attached by ratcheting onto the first wall of the socket (1).

4. A shielded connector according to claim 2, wherein the second shielding on the first wall of the socket (1) comprises several of the spring tabs (22) separated by narrow slots, so that rubbing contact between the base of the "V" of the projections and the first shielding of the plug covers roughly the entire width of the first shielding (9*a*) of the plug (7).

5. A shielded electrical connector comprising:

a socket with a first electrically conductive shielding on a first outer wall of the socket, and a second electrically conductive shielding on a second outer wall of the socket, the first shielding having at least one resiliently flexible grounding tab cantilevered and extending outwardly therefrom at a front end of the socket, the grounding tab having a general V shape with a hook member projecting from a bottom of the V shape, and the second shielding hating a least one spring contact thereon, the spring contact being located inside the socket; and a plug with a portion of the plug being adapted to be received into the front end of the socket, the plug having an outer electrically conductive shield;

wherein, when the portion of the plug is located in the socket, the spring contact contacts one second side of the outer shield of the plug inside the socket and biases the plug against the grounding tab wherein the bottom of the V shaped grounding tab contacts a first side of conductive shield on the plug and the hook member on the grounding tab engages the first side of the shield on the plug to lock the plug to the socket.

6. A shielded electrical connector as in claim 5, further comprising:

a lever, the lever being cantilevered from a cantilevered end of the grounding tab and being interlocked to the cantilevered end of the grounding tab so that the lever and cantilevered end of the grounding tab move together as a unit;

wherein, when the portion of the plug is located in the socket, the lever has an angled surface orientated at an angle relative to a seating surface of the plug so that an inner edge of the angled surface is adjacent the seating surface of the plug; and wherein when the angled surface of the lever is pressed against the seating surface of the plug the inner edge rests on the seating surface and forms a fulcrum about which the lever rocks to resiliently deflect the grounding tab so that the hook member is disengaged from the first conductive surface of the plug.

7. A shielded electrical connector comprising a socket and a plug adapted to be mated with the socket, the socket having exterior electrically conductive shielding and a latch thereon, the plug having exterior electrically conductive shielding with an engagement surface, wherein the improvement comprises:

the latch comprising a first conductive latch member having a general V shape with a hook member projecting from a bottom of the V shape and a second insulating latch member, the first latch member being an elongated cantilever extending from the shielding of the socket and the hook member engaging the engagement surface on the shielding of the plug when the plug is mated to the socket, the second latch member having a seating surface with a chamfer formed therein and the second latch member being interlocked with the first latch member wherein when the second latch member pivots about an inner edge of the chamfer the first latch member moves with the second latch member to release the hook member of the first latch member from the engagement surface on the plug.

8. A shielded electrical connector as in claim 7, wherein the seating surface of the second latch member is disposed adjacent the plug wherein when the chamfer is pressed towards the plug the inner edge of the chamfer rests against the plug and the second latch member pivots about the inner edge of the chamfer.

9. A shielded electrical connector as in claim 7, wherein the first latch member has a contact surface, the contact surface having a bottom adapted to galvanically contact the shielding of the plug when the plug is mated to the socket, and wherein the bottom of the contact surface has the hook member projecting therefrom.

* * * * *